US007425172B2

(12) United States Patent
Misra et al.

(10) Patent No.: US 7,425,172 B2
(45) Date of Patent: Sep. 16, 2008

(54) CUSTOMIZED POLISH PADS FOR CHEMICAL MECHANICAL PLANARIZATION

(75) Inventors: Sudhanshu Misra, Sunnyvale, CA (US); Pradip K. Roy, Orlando, FL (US)

(73) Assignee: NexPlanar Corporation, Hillsboro, OR (US)

( * ) Notice: Subject to any disclaimer, the term of this patent is extended or adjusted under 35 U.S.C. 154(b) by 448 days.

(21) Appl. No.: 10/810,070

(22) Filed: Mar. 25, 2004

(65) Prior Publication Data

US 2005/0009448 A1 Jan. 13, 2005

Related U.S. Application Data

(60) Provisional application No. 60/457,273, filed on Mar. 25, 2003.

(51) Int. Cl.
*B24B 49/00* (2006.01)
*B24B 51/00* (2006.01)
*B24B 1/00* (2006.01)

(52) U.S. Cl. ..... 451/5; 451/8; 451/56; 438/690; 700/97; 700/117; 700/121; 703/6; 703/7

(58) Field of Classification Search ..... 451/5, 451/6, 8, 41, 56, 530, 533; 438/690–692; 700/97, 117, 121; 703/6, 7
See application file for complete search history.

(56) References Cited

U.S. PATENT DOCUMENTS 5,526,293 A * 6/1996 Mozumder et al. ..... 716/19
5,562,530 A * 10/1996 Runnels et al. ..... 451/36
5,599,423 A * 2/1997 Parker et al. ..... 438/692
5,637,031 A * 6/1997 Chen ..... 451/41
5,655,951 A 8/1997 Meikle et al.
5,975,991 A 11/1999 Karlsrud
6,030,488 A 2/2000 Izumi et al.
6,077,153 A 6/2000 Fujita et al.

(Continued)

FOREIGN PATENT DOCUMENTS

EP 0 845 328 6/1998

(Continued)

OTHER PUBLICATIONS

Boning, D. et al. (Apr. 1999), "Pattern Dependent Modeling for CMP Optimization and Control," *Proc. Symposium P: Chemical Mechanical Polishing*, pp. 1-13.

(Continued)

*Primary Examiner*—Maurina Rachuba
(74) *Attorney, Agent, or Firm*—Morrison Foerster LLP

(57) ABSTRACT

A polishing pad for chemical mechanical planarization of a film on a substrate is customized by obtaining one or more characteristics of a structure on a substrate. For example, when the structure is a chip formed on a semiconductor wafer, the one or more characteristics of the structure can include chip size, pattern density, chip architecture, film material, film topography, and the like. Based on the one or more characteristics of the structure, a value for the one or more chemical or physical properties of the pad is selected. For example, the one or more chemical or physical properties of the pad can include pad material hardness, thickness, surface grooving, pore size, porosity, Youngs modulus, compressibility, asperity, and the like.

24 Claims, 3 Drawing Sheets

U.S. PATENT DOCUMENTS

| | | | | |
|---|---|---|---|---|
| 6,089,966 | A | 7/2000 | Arai et al. | |
| 6,169,931 | B1 * | 1/2001 | Runnels | 700/97 |
| 6,214,732 | B1 | 4/2001 | Easter et al. | |
| 6,258,231 | B1 | 7/2001 | Easter et al. | |
| 6,315,645 | B1 * | 11/2001 | Zhang et al. | 451/65 |
| 6,319,095 | B1 | 11/2001 | Merchant et al. | |
| 6,328,633 | B1 | 12/2001 | Misra et al. | |
| 6,364,722 | B1 | 4/2002 | Yamamoto | |
| 6,364,742 | B1 | 4/2002 | Fukuzawa | |
| 6,364,744 | B1 | 4/2002 | Merchant et al. | |
| 6,368,200 | B1 | 4/2002 | Merchant et al. | |
| 6,375,541 | B1 | 4/2002 | Merchant et al. | |
| 6,436,830 | B1 | 8/2002 | Merchant et al. | |
| 6,439,972 | B2 | 8/2002 | Misra et al. | |
| 6,458,016 | B2 | 10/2002 | Merchant et al. | |
| 6,458,289 | B1 | 10/2002 | Merchant et al. | |
| 6,459,945 | B1 * | 10/2002 | Singh et al. | 700/108 |
| 6,461,225 | B1 | 10/2002 | Misra et al. | |
| 6,484,300 | B1 * | 11/2002 | Kim et al. | 716/7 |
| 6,567,718 | B1 * | 5/2003 | Campbell et al. | 700/121 |
| 6,572,439 | B1 * | 6/2003 | Drill et al. | 451/5 |
| 6,599,837 | B1 | 7/2003 | Merchant et al. | |
| 6,659,846 | B2 | 12/2003 | Misra et al. | |
| 6,676,483 | B1 | 1/2004 | Roberts | |
| 6,682,398 | B2 * | 1/2004 | Meyer | 451/5 |
| 6,722,962 | B1 * | 4/2004 | Sato et al. | 451/259 |
| 6,802,045 | B1 * | 10/2004 | Sonderman et al. | 716/2 |
| 6,889,177 | B1 * | 5/2005 | Runnels | 703/2 |
| 2001/0036795 | A1 | 11/2001 | Merchant et al. | |
| 2001/0036796 | A1 | 11/2001 | Misra et al. | |
| 2002/0115385 | A1 * | 8/2002 | Misra et al. | 451/41 |
| 2002/0197934 | A1 | 12/2002 | Paik | |
| 2003/0054735 | A1 | 3/2003 | Misra et al. | |

FOREIGN PATENT DOCUMENTS

| | | |
|---|---|---|
| EP | 0 919 336 | 6/1999 |
| TW | 471992 B | 1/2001 |
| TW | 436374 B | 5/2001 |
| TW | 436379 B | 5/2001 |
| TW | 480616 B | 3/2002 |
| WO | WO 02/102549 | 12/2002 |

OTHER PUBLICATIONS

Chen, Y. et al. (Jun. 2000), "Practical Iterated Fill Synthesis for CMP Uniformity," prepared by the Computer Science Departments of UCLA, the University of Virgina, and Georgia State University, 4 pages.

Fu, G. et al. (2002), "A Model for Wafer Scale Variation of Material Removal Rate in Chemical Mechanical Polishing Based on Viscoelastic Pad Deformation," *Journal of Electronic Materials* 31(10):1066-1073.

Gostein, M. et al. (Mar. 2002). "Characterizing and Monitoring Copper CMP Using Nondestructive Optoacoustic Metrology," provided by Micromagazine.com, located at http://www.micromagazine.com/archive/02/03/gostein.html, last visited on Mar. 4, 2004, 13 pages.

Luo, J. et al. (May 2001). "Material Removal Mechanism in Chemical Mechanical Polishing: Theory and Modeling," *IEEE Transactions on Semiconductor Manufacturing* 14(2):112-133.

Noh, K. et al. (Jan. 2002). "Mechanics, Mechanisms and Modeling of the Chemical Mechanical Polishing Process," 10 pages.

Oji, C. et al. (2000). "Wafer Scale Variation of Planarization Length in Chemical Mechanical Polishing," *Journal of the Electrochemical Society* 147(11):4307-4312.

Ouma, D. O. et al. (May 2002). "Characterization and Modeling of Oxide Chemical Mechanical Polishing Using Planarization Length and Pattern Density Concepts," *IEEE Transactions on Semiconductor Manufacturing* 15(2):232-244.

Philipossian, A. et al. (2003). "Fundamental Tribological and Removal Rate Studies of Inter-Layer Dielectric Chemical Mechanical Planarization," *Japan J. Appl. Phys* 42(10):6371-6379.

SKW Associates, Inc. (Date Unknown). "Planarization Length: Concept and Determination in Dielectric CMP Process," 2 pages.

Stine, V. et al. (Feb. 1998). "Rapid Characterization and Modeling of Pattern Dependent Variation in Chemical Polishing," *IEEE Transactions on Semiconductor Manufacturing* 11(1):129-140.

Tung, T-L (Sep. 1997). "A Method for Die-Scale Simulation of CMP Planarization," *IEEE* pp. 65-68.

Taiwan Search Report mailed on Jun. 11, 2007, for Taiwan Application No. 093108134, filed on Mar. 25, 2004, two pages.

* cited by examiner

CUSTOMIZED POLISH PADS FOR CHEMICAL MECHANICAL PLANARIZATION

CROSS-REFERENCE TO RELATED APPLICATION

This application claims the benefit of U.S. Provisional Application No. 60/457,273, titled CHIP CUSTOMIZED POLISH PADS FOR CHEMICAL MECHANICAL PLANARIZATION (CMP), filed Mar. 25, 2003, the entire content of which is incorporated herein by reference.

BACKGROUND

1. Field of the Invention

The present application relates to polishing pads for chemical mechanical planarization (CMP) of substrates and, more particularly, to polishing pads customized for structures on the substrates.

2. Related Art

Chemical mechanical planarization (CMP) is used to planarize films on substrates, such as individual layers (dielectric or metal layers) during integrated circuit (IC) fabrication on a semiconductor wafer. CMP removes undesirable topographical features of the film on the substrate, such as metal deposits subsequent to damascene processes, or removal of excess oxide from shallow trench isolation steps.

CMP utilizes a reactive liquid medium and a polishing pad surface to provide the mechanical and chemical control necessary to achieve planarity. Either the liquid or the polishing surface (pad) can contain nano-size inorganic particles to enhance chemical reactivity and/or mechanical activity of the CMP process. The pad is typically made of a rigid, microporous polyurethane material capable of achieving both local and global planarization.

Conventional open-pore and closed-pore polymeric pads with essentially homogeneous tribological, chemical and frictional characteristics were previously suitable for CMP, until the introduction of 250 nm CMOS technology. For sub 250 nm technology with increased design complexity and associated chip pattern density variations, especially with increased chip size, the chip yields, device performance and device reliability have deteriorated significantly. Recent attempts by various pad vendors to change the thickness (stacked and unstacked) and surface grooving (perforated, K-groove, X-Y groove, and K-groove/X-Y groove combinations) of the pads have failed to address the impact that chip pattern density, chip size, complexity of architecture, and dielectric/metal process flow have on chip-level uniformity directly impacting chip yield, device performance and reliability of integrated circuits.

SUMMARY

In one exemplary embodiment, a polishing pad for chemical mechanical planarization of a film on a substrate is customized by obtaining one or more characteristics of a structure on a substrate. For example, when the structure is a chip formed on a semiconductor wafer, the one or more characteristics of the structure can include chip size, pattern density, chip architecture, film material, film topography, and the like. Based on the one or more characteristics of the structure, a value for the one or more chemical or physical properties of the pad is selected. For example, the one or more chemical or physical properties of the pad can include pad material hardness, thickness, surface grooving, pore size, porosity, Youngs modulus, compressibility, asperity, and the like.

DESCRIPTION OF DRAWING FIGURES

The present application can be best understood by reference to the following description taken in conjunction with the accompanying drawing figures, in which like parts may be referred to by like numerals:

DETAILED DESCRIPTION

The following description sets forth numerous specific configurations, parameters, and the like. It should be recognized, however, that such description is not intended as a limitation on the scope of the present invention, but is instead provided as a description of exemplary embodiments.

Figure 1:
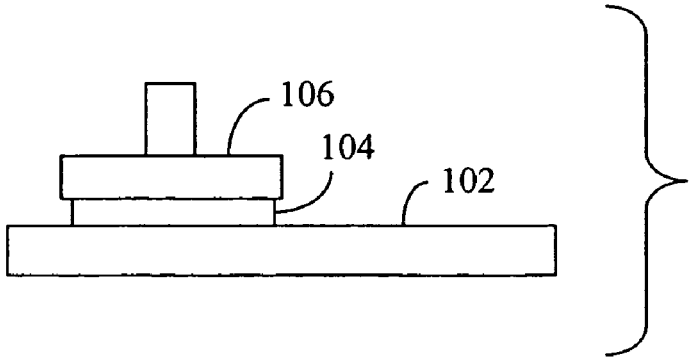
FIG. 1 depicts an exemplary polishing pad used in a chemical mechanical planarization (CMP) process.

With reference to FIG. 1, an exemplary polishing pad 102 for chemical mechanical planarization (CMP) processing of a semiconductor wafer 104 is depicted. To planarize a layer formed on wafer 104, a holder 106 holds wafer 104 on pad 102 while wafer 104 and pad 102 are rotated. As described above, in a typical CMP process, a reactive liquid medium (a slurry) is also used to enhance the CMP process. It should be recognized, however, pad 102 can be used for CMP processing of film on various types of structures and various types of substrates, such as optoelectronic devices, magnetic or optical disks, ceramic and nano-composite substrates, and the like.

In one exemplary embodiment, pad 102 is customized based on one or more chemical or physical properties of a structure on a substrates, such as a chip on wafer 104. It should be recognized that the one or more characteristics of the chips can be obtained from actual chips formed on a wafer. Alternatively, the one or more characteristics of the chips can be obtained from a design for chips to be formed on a wafer.

In the present exemplary embodiment, the one or more characteristics of a structure on the substrate are obtained. For example, when the structure is a chip formed on a wafer, the one or more characteristics of the chip can include chip size, pattern density, chip architecture, film material, film topography, and the like. Based on the one or more characteristics of the structure, a value for the one or more chemical or physical properties of the pad is selected. The one or more chemical or physical properties of the pad can include pad material hardness, thickness, surface grooving, pore size, porosity, Youngs modulus, compressibility, asperity, and the like. The one or more chemical or physical properties of the pad also includes tribological or material properties, which can include one or more of the examples previously set forth.

For example, assuming that the structure is a chip and the substrate is a wafer, a pad for smaller chip size (e.g., less than 1 sq cm in area, notably less than 0.5 sq cm) can have different values for the one or more chemical or physical properties than for larger chip size (greater than 1 sq cm in area). One property of the pad that can be selected based on the chip size is the pad material hardness. In particular, harder pad material (e.g., hardness greater than 90D shore, notably greater than 60D shore hardness) is used for larger chip size than for smaller chip size. Another property of the pad that can be selected based on chip size is pore size. In particularly, smaller pore size is used for larger chip size than for smaller chip size. Still another property of the pad that can be selected based on chip size is porosity. In particular, smaller porosity is used for larger chip size than for smaller chip size. Yet another property of the pad that can be selected based on chip size is asperity. In particular, a smaller asperity with larger distribution is used for larger chip size than for smaller chip size.

Figure 2A:
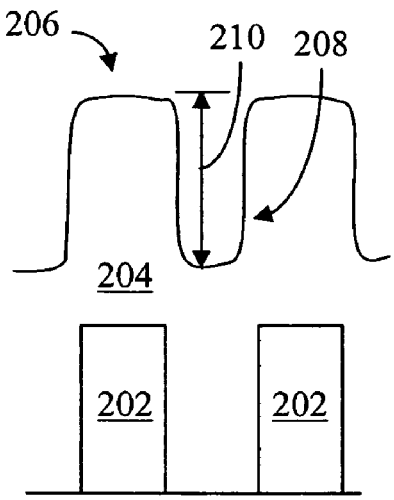
FIGS. 2A and 2B depict an exemplary deposition layer formed on an underlying layer.
Figure 2B:
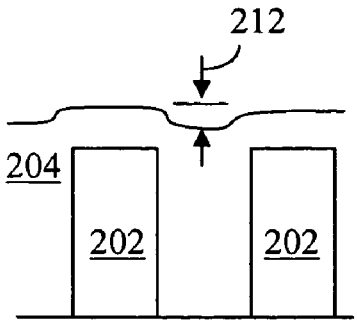

Also, the pattern density of a chip can affect the film removal amount and the uniformity within a chip and across a wafer. (See, T. Lung, "A Method for die-scale simulation for CMP planarization," in Proc. SISPAD conf., Cambridge, Mass., September 1997.) With reference to FIG. 2A, underlying features 202, such as metal lines, of a deposited film 204 can create high regions 206 and low regions 208 in the topography. In particular, topography is strongly dependent on pattern density in copper based dual damascene structures because of the nature of electroplating in trenches that have different widths across a chip and the chemistry associated with the additives used in the electroplating process. In general, high regions 206 in the topography polish faster than the low regions 208. As depicted in FIG. 2A, an initial step height 210 is associated with deposited film 204 before polishing. As depicted in FIG. 2B, a final step height 212 is associated with deposited film 204 after polishing. The differential rate for high regions 206 and low regions 208 removal, indicated by the difference in initial step height 210 and final step height 212, is a figure of merit for planarization. The larger this difference, the better the planarity after the CMP process.

One factor influencing planarity is the pad bending or viscoelastic behavior of most cross-linked polyurethane thermosets and elastomeric materials during the CMP process. Thus, a pad for lower pattern density can have different properties than for higher pattern density.

For example, lower pattern density exists for smaller chip size, such as a pattern density of less than 30 percent. Higher pattern density exists for larger chip size, such as a pattern density of greater than 50 percent. One property of the pad that can be selected based on the pattern density is the pad material hardness. In particular, harder pad material (e.g., hardness greater than 90D shore, notably greater than 60D shore hardness) is used for chips with higher pattern density than with lower pattern density. Another property of the pad that can be selected based on pattern density is asperity or asperity distribution. In particular, a smaller asperity and/or larger asperity distribution is used for higher pattern density than for lower pattern density.

Figure 3A:
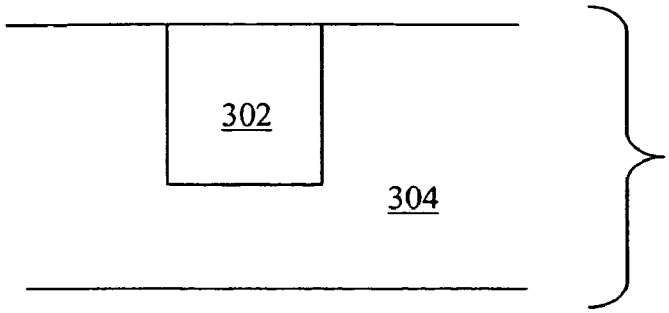
FIGS. 3A and 3B depict dishing and erosion in a metal deposited within a trench in a dielectric layer.
Figure 3B:
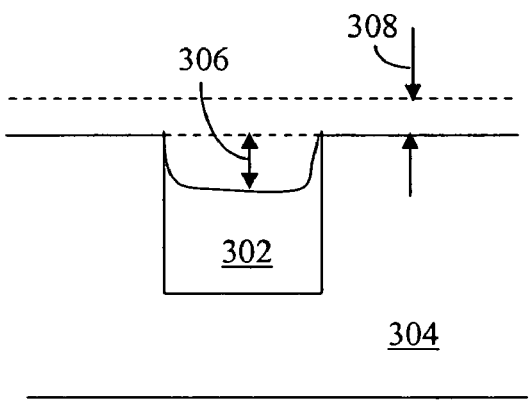

The film material can also affect the uniformity within a chip and across a wafer. In particular, dishing and/or erosion can occur in a CMP process involving multiple film materials because the different materials can have different polishing rates. For example, with reference to FIG. 3A, a metal line 302 deposited within a trench in a dielectric layer 304 is depicted. With reference to FIG. 3B, dishing of metal line 302 is depicted as a deviation in height 306 of metal line 302 from planarity with dielectric layer 304. Also, erosion of dielectric layer 304 is depicted as a deviation in height 308 of dielectric layer 304 from its intended height. Dishing and/or erosion can exist in shallow trench isolation (STI), tungsten plug, and dual damascene process for copper based interconnects. Also, when copper is used, an additional film material is used as a barrier layer between the copper and the dielectric material. Because different film materials can have different polishing rates, dishing and/or erosion occur. Additionally, dishing and/or erosion can be aggravated when the CMP process involves over-polishing.

Thus, when multiple film materials are used, a value for the one or more properties of the pad can be selected to reduce dishing and/or erosion. For example, a pad for greater numbers of different materials can have different properties than for fewer numbers of different materials. One property of the pad that can be selected based on the number of different material is the pad material hardness. In particular, to reduce dishing and/or erosion, harder pad material (e.g., hardness greater than 90D shore, notably greater than 60D shore hardness) is used for greater numbers of different materials than for fewer numbers of different materials.

It should be recognized that the one or more characteristics of the chips on the wafer can vary in different regions on the wafer. Thus, in one exemplary embodiment, the one or more chemical or physical properties of the pad are varied in different regions on the wafer. For example, pattern density can vary from the center of the wafer to the edge of the wafer. In particular, because a wafer is typically circular and chips are designed to be either square or rectangular, there are regions on the wafer along the circumference area that have low or no pattern density. Thus, a pad can have a variation in one or more chemical or physical properties of the pad from the center of the wafer to the edge of the wafer.

In one exemplary embodiment, a value for the one or more chemical or physical properties of the pad can be selected based on one or more characteristics of the structure on the substrate by performing a simulation using a model of the CMP process. The simulation is performed using the one or more obtained characteristics of the structure and a range of values for the one or more chemical or physical properties of the pad. The model of the CMP process used in the simulations provides the effects of varying the values of the one or more chemical or physical properties of the pad on the planarization of the substrate. From the simulation, a correlation can be obtained between the one or more chemical or physical properties of the pad and the planarization of the substrate. Thus, a value for the one or more chemical or physical properties of the pad can be selected to optimize planarization of the substrate.

For example, assuming the structure is a chip and the substrate is a wafer, a pattern density dependent analytic model can be used in the simulation. (See, B. Stine, et al., "Rapid Characterization and modeling of pattern dependent variation in chemical polishing," IEEE Transactions on Semiconductor Manufacturing, vol. 11, pp 129-140, February 1998; and D. O. Ouma, eta al., "Characterization and Modeling of Oxide Chemical Mechanical Polishing Using Planarization Length and Pattern Density Concepts," IEEE Transactions on Semiconductor Manufacturing, vol. 15, no. 2, pp 232-244, May 2002.) It should be recognized, however, that various types of models of the CMP process can be used.

One input to the model is the pattern density of the chips on the wafer. As noted above, the pattern density can be obtained from actual chips formed on the wafer or from chip design or architecture.

Figure 4A:
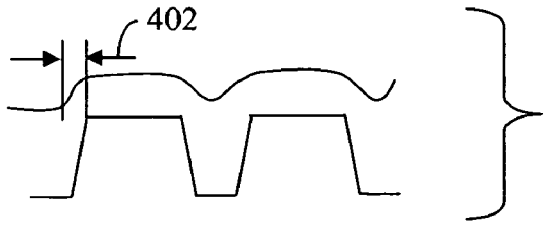
FIGS. 4A and 4B depict positive and negative deposition bias.
Figure 4B:
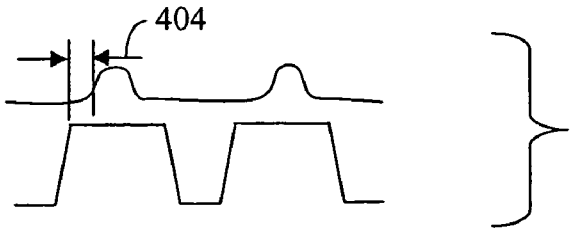

Another input to the model is a deposition bias associated with the layers of material deposited on the wafer. The deposition bias indicates the variation between the actual deposition profile "as deposited" and the predicted deposition profile "as drawn." For example, the pattern density "as deposited" (i.e., the pattern density that actually results on the chip may not necessarily reflect the pattern density "as drawn" (i.e., the pattern density as intended in the design of the chip). This is due, in part, to the fact that during the IC processing steps, the film (either metal or insulating dielectrics) transfer the pattern in different ways depending on the deposition process used (e.g., electroplated, thermal chemical vapor deposition—CVD, physical vapor deposition—PVD, plasma enhanced (PE), atmospheric (AP) or low pressure (LP) or subatmospheric (SA) chemical vapor deposition—PECVD, APCVD, LPCVD, SACVD, spin coating, atomic layer deposition—ALD, and the like). Each of these processing methods can affect the underlaying pattern density differently. For example, PECVD deposited films have a negative bias compared to SACVD deposited films. Furthermore, the types of film (fluorine doped silicate glass, FSG, compared to undoped silicate glass USG or SiO2) have different effects on the pattern density. As depicted in FIGS. 4A and 4B, SiO2 or USG films can have a positive bias 402, while FSG films have a negative bias 404.

As another input to the model, a set of test wafers can be polished using pads having different values for the one or more obtained properties. Film thicknesses and profiles of the planarized chips on the test wafers are obtained, such as final step height at specific pattern features and total indicated range (TIR—the maximum minus minimum measured thickness within a chip), which are then used as inputs to the model.

Based on the inputs, the model calculates an average or effective pattern density across a chip using a fast Fourier transform (FFT). Based on the effective pattern density, post-CMP film thickness and profile across patterned chips can be predicted, such as step height and TIR.

Figure 5:
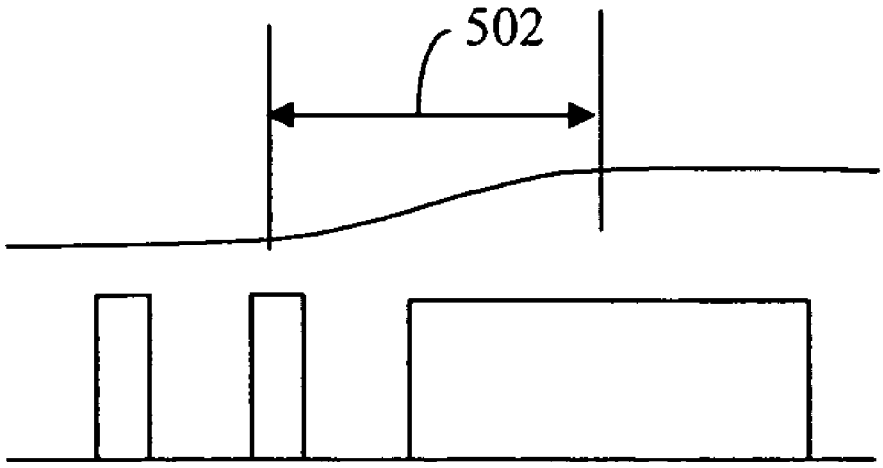
FIG. 5 depicts an exemplary planarization length.

The model can also provide a calculation of a planarization length associated with a pad. Although definitions of planarization length (PL) vary, with reference to FIG. 5, one possible definition is as a characteristic length scale 502, a circle of which radius ensures uniformity of film thickness within 10 percent of the value at that certain location. As an example, a PL of 5 mm means all features (high and low) within 5 mm of any location within a chip are planarized with film thickness variation within 10 percent. Essentially, a high PL is desirable for best planarity. Thus, PL is a figure of merit for a pad performance. A PL of 5 mm is well suited for a chip size, say 5 mm×5 mm, but not for a chip size of 15 mm×15 mm (large chip size). The result will be non-uniformity of the film that gets severe upon film buildup as multi layers are deposited, and the result is loss of printing of device features, ultimately resulting in yield loss.

After planarization length is obtained from the model, a sensitivity analysis can be used to correlate the planarization length to the one or more chemical or physical properties of the pad. This correlation can then be used to select a value for the one or more chemical or physical properties of the pad to optimized planarization length.

The model can also identify dishing and/or erosion that may result from a CMP process. In particular, the model predicts the location and amount of dishing and/or erosion that may result on the chip. A sensitivity analysis can be used to correlate dishing and/or erosion to the one or more chemical or physical properties of the pad. This correlation can then be used to select a value for the one or more chemical or physical properties of the pad to minimize dishing and/or erosion.

The model can also identify over-polishing and/or under-polishing that may result from a CMP process. In particular, the model predicts the location and amount of over-polishing and/or under-polishing that may result on the chip. A sensitivity analysis can be used to correlate over-polishing and/or under-polishing to the one or more chemical or physical properties of the pad. This correlation can then be used to select a value for the one or more chemical or physical properties of the pad to minimize over-polishing and/or under-polishing.

A pad with the selected value for the one or more properties of the pad can be produced by adjusting the chemical formulations of the pad (e.g., use of extending agents, curing agents and cross linkers). For example, polish pads are preferably polyurethane based pads that may be either thermoplastic or thermosets. (See, A. Wilkinson and A. Ryan, "Polymer Processing and Structure Development," Kluwer Academic publishers, 1999; and R. B. Seymour and C. E. Carraher, Jr., "Polymer Chemistry: An Introduction.") To minimize pressure induced pad deformation, it is desirable to formulate rigid polyurethane foams. A desirable formulation chemistry involves a polyol-isocyanate chemistry. The pads are desired to be porous; howver, they can be rigid as well, and can contain pores or can be formed without pores. Typical isocyantes can be TDI (toluene di-isocyanate), PMDI (polymeric methylene di phenyl isocyanate). Polyols can be PPG (polypropylene glycol), PEG (polyethylene glycol), TMP (trimethylol propane glycol), IBOH (hydroxyl terminated isobutylene). A variety of cross linking agents such as primary, secondary and tertiary polyamines, TMP, butane 1,4 diol, triethanol amine are useful for providing polymer cross linking adding to structural hardness. Chain extending agents such as MOCA (methylene 'bis' orthochloroaniline, and theylene glycol are well suited for providing long-range or short range effects at the micro level. Curative agents such as diols and triols can be used to vary polymer properties. Catalysts such as Diaza (2,2,2) biscyclooctane facilitate reaction and affect the degree of polymerization. Surfactants are used to modulate the degree of interconnection.

In the present exemplary embodiment, validations of chemical formulations of a pad can be generated through testing in the field with wafers with test chips of varying pattern densities, linewidth and pitches that simulate small, medium and large chip products in the IC manufacturing world. One such test chip typically used industry wide is the mask set designed by MIT Microelectronics lab.

Although exemplary embodiments have been described, various modifications can be made without departing from the spirit and/or scope of the present invention. Therefore, the present invention should not be construed as being limited to the specific forms shown in the drawings and described above.

We claim:

1. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and wherein the one or more characteristics of the structure includes a pattern density of the structure.

2. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and wherein the one or more characteristics of the structure includes film material and a number of different materials.

3. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and wherein the one or more chemical or physical properties for the pad includes hardness, thickness, surface grooving, porosity, Young's modulus, compressibility, or asperity of the pad.

4. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and further comprising:

providing a pattern density and a deposition bias as inputs to the model of the CMP process.

5. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and further comprising:

obtaining a planarization length from the model of the CMP process; and performing a sensitivity analysis to determine a correlation between the planarization length and the one or more chemical or physical properties of the pad.

6. The method of claim 5, wherein the value for the one or more chemical or physical properties of the pad is selected based on the determined correlation between the planarization length and the one or more chemical or physical properties of the pad to optimize the planarization length.

7. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and further comprising:

identifying dishing and/or erosion from the model of the CMP process; and performing a sensitivity analysis to determine a correlation between the one or more chemical or physical properties of the pad and dishing and/or erosion.

8. The method of claim 7, wherein the value for the one or more chemical or physical properties of the pad is selected based on the determined correlation between the one or more chemical or physical properties of the pad and the dishing and/or erosion to reduce the dishing and/or erosion.

9. A method of making a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and further comprising:

identifying over-polishing and/or under-polishing from the model of the CMP process; and performing a sensitivity analysis to determine a correlation between the one or more chemical or physical properties of the pad and over-polishing and/or under-polishing.

10. The method of claim 9, wherein the value for the one or more chemical or physical properties of the pad is selected based on the determined correlation between the one or more chemical or physical properties of the pad and the over-polishing and/or under-polishing to reduce the over-polishing and/or under-polishing.

11. A method of customizing a polishing pad for chemical mechanical planarization of a substrate, the method comprising:

obtaining one or more characteristics of a structure on the substrate;

selecting a value for one or more chemical or physical properties for the pad to be used in chemical mechanical planarization of the substrate based on the obtained one or more characteristics of said structure on the substrate; and making the pad having said value for the one or more chemical or physical properties, wherein selecting the value for one or more chemical or physical properties for the pad comprises:

performing a simulation of planarization of the substrate with a model of a CMP process using the pad with a range of values for the one or more chemical or physical properties of the pad; and selecting the value for the one or more chemical or physical properties based on the simulation, and wherein the structure is an optoelectronic device.

12. A method of making a polishing pad for chemical mechanical planarization of a semiconductor wafer, the method comprising:

obtaining one or more characteristics of a chip;

performing a simulation of a chemical mechanical planarization of the wafer with a model of a CMP process using the obtained one or more characteristics of the chip and a range of values for the one or more chemical or physical properties of the pad;

selecting a value for one or more chemical or physical properties for the pad based on the simulation, wherein the one or more characteristics of the chip includes a pattern density of the chip; and making the pad having said value for the one or more chemical or physical properties.

13. The method of claim 12, wherein the one or more chemical or physical properties for the pad includes hardness, thickness, surface grooving, porosity, Young's modulus, compressibility, or asperity of the pad.

14. A method of making a polishing pad for chemical mechanical planarization of a semiconductor wafer, the method comprising:

obtaining one or more characteristics of a chip;

performing a simulation of a chemical mechanical planarization of the wafer with a model of a CMP process using the obtained one or more characteristics of the chip and a range of values for the one or more chemical or physical properties of the pad;

selecting a value for one or more chemical or physical properties for the pad based on the simulation, and further comprising:

obtaining a planarization length from the model of the CMP process; and performing a sensitivity analysis to determine a correlation between the planarization length and the one or more chemical or physical properties of the pad; and further comprising making the pad having said value for the one or more chemical or physical properties.

15. The method of claim 14, wherein the value for the one or more chemical or physical properties of the pad is selected based on the determined correlation between the planarization length and the one or more chemical or physical properties of the pad to optimize the planarization length.

16. A method of making a polishing pad for chemical mechanical planarization of a semiconductor wafer, the method comprising:

obtaining one or more characteristics of a chip;

performing a simulation of a chemical mechanical planarization of the wafer with a model of a CMP process using the obtained one or more characteristics of the chip and a range of values for the one or more chemical or physical properties of the pad; and selecting a value for one or more chemical or physical properties for the pad based on the simulation, and further comprising:

identifying dishing and/or erosion from the model of the CMP process; and performing a sensitivity analysis to determine a correlation between the one or more chemical or physical properties of the pad and the dishing and/or erosion; and further comprising making the pad having said value for the one or more chemical or physical properties.

17. The method of claim 16, wherein the value for the one or more chemical or physical properties of the pad is selected based on the determined correlation between the one or more chemical or physical properties of the pad and the dishing and/or erosion to reduce the dishing and/or erosion.

18. A method of making a polishing pad for chemical mechanical planarization of a semiconductor wafer, the method comprising:

obtaining one or more characteristics of a chip;

performing a simulation of a chemical mechanical planarization of the wafer with a model of a CMP process using the obtained one or more characteristics of the chip and a range of values for the one or more chemical or physical properties of the pad; and selecting a value for one or more chemical or physical properties for the pad based on the simulation, and further comprising:

identifying over-polishing and/or under-polishing from the model of the CMP process; and performing a sensitivity analysis to determine a correlation between the one or more chemical or physical properties of the pad and the over-polishing and/or under-polishing; and further comprising making the pad having said value for the one or more chemical or physical properties.

19. The method of claim 18, wherein the value for the one or more chemical or physical properties of the pad is selected based on the determined correlation between the one or more chemical or physical properties of the pad and the over-polishing and/or under-polishing to reduce the over-polishing and/or under-polishing.

20. A method of making a pad used in chemical mechanical polishing (CMP) to planarize a metal or dielectric film comprising:

selecting a value for one or more chemical or physical properties of the pad to compensate for pattern density effects of different chip or substrate architectures optimizing the pad for a derived planarization length, response characteristics for dishing and/or erosion, or final step height at specific pattern features to attain local and global planarization of the chip or substrate and making the pad based on said value and after said optimizing.

21. The method of claim 20, wherein the optimization is performed for planarization of a silicon integrated circuit.

22. The method of claim 20, wherein the optimization is performed for planarization of an optoelectronic device.

23. The method of claim 20, wherein the optimization is performed for planarization of a magnetic or optical disk.

24. The method of claim 20, wherein the optimization is performed for planarization of a film on a ceramic or nanocomposite substrate.

* * * * *